US006927652B2

(12) United States Patent
Hidalgo Carpintero et al.

(10) Patent No.: US 6,927,652 B2
(45) Date of Patent: Aug. 9, 2005

(54) CANONICAL GENERAL RESPONSE BANDPASS MICROWAVE FILTER

(75) Inventors: Isidro Hidalgo Carpintero, Madrid (ES); Elvira Cervera Cruanes, Madrid (ES); Manuel Jesus Padilla Cruz, Madrid (ES)

(73) Assignee: Alcatel, Paris (FR)

( * ) Notice: Subject to any disclaimer, the term of this patent is extended or adjusted under 35 U.S.C. 154(b) by 70 days.

(21) Appl. No.: 10/627,771

(22) Filed: Jul. 28, 2003

(65) Prior Publication Data

US 2004/0056737 A1 Mar. 25, 2004

(30) Foreign Application Priority Data

Jul. 29, 2002 (EP) ..... 02291913

(51) Int. Cl.[7] ..... H01P 1/20
(52) U.S. Cl. ..... 333/202; 333/208
(58) Field of Search ..... 333/202, 203, 333/208, 209, 212; 310/322; 331/49; 342/375

(56) References Cited

U.S. PATENT DOCUMENTS 4,547,748 A * 10/1985 Ballato ..... 331/49
4,677,402 A * 6/1987 Cesani et al. ..... 333/203
5,512,906 A * 4/1996 Speciale ..... 342/375
5,608,363 A 3/1997 Cameron et al.
5,684,438 A * 11/1997 Cavalieri D'Oro et al. . 333/202
5,698,928 A * 12/1997 Mang et al. ..... 310/322
5,774,030 A * 6/1998 Gray ..... 333/212
5,783,979 A * 7/1998 Andoh et al. ..... 333/202
5,812,036 A * 9/1998 Estrada ..... 333/202
6,046,658 A * 4/2000 Tatomir et al. ..... 333/208
6,111,483 A * 8/2000 Haapakoski ..... 333/202
6,559,740 B1 * 5/2003 Schulz et al. ..... 333/202

FOREIGN PATENT DOCUMENTS

DE 2 161 792 A 6/1973

OTHER PUBLICATIONS

Pfitzenmaier G: "Synthesis and Realization of Narrow–Band Canonical Microwave Bandpass Filters Exhibiting Linear Phase and Transmission Zeros" IEEE Transactions on Microwave Theory and Techniques, IEEE Inc, New York, US, bol. 30, No. 9, Sep. 1, 1982, pp. 1300–13111, XP000563261.

* cited by examiner

*Primary Examiner*—Patrick Wamsley
(74) *Attorney, Agent, or Firm*—Sughrue Mion, PLLC

(57) ABSTRACT

A microwave filter including a plurality of resonator cavities (1, 10) arranged in more than two adjacent rows and more than two adjacent columns; wherein each resonator cavity is coupled with at least a sequential adjacent resonator cavity for providing a main path for an electromagnetic energy to be transmitted from a first resonator cavity (1) to a last resonator cavity (10). The electromagnetic energy is injected into the first resonator cavity (1) by an input terminal (20) through an input coupling, and the electromagnetic energy is extracted from the last resonator cavity (10) by an output terminal (21) through an output coupling, and the first (1) and last (10) resonator cavities are non-sequential adjacent cavities.

15 Claims, 4 Drawing Sheets

CANONICAL GENERAL RESPONSE BANDPASS MICROWAVE FILTER

OBJECT OF THE INVENTION

Figure 1:
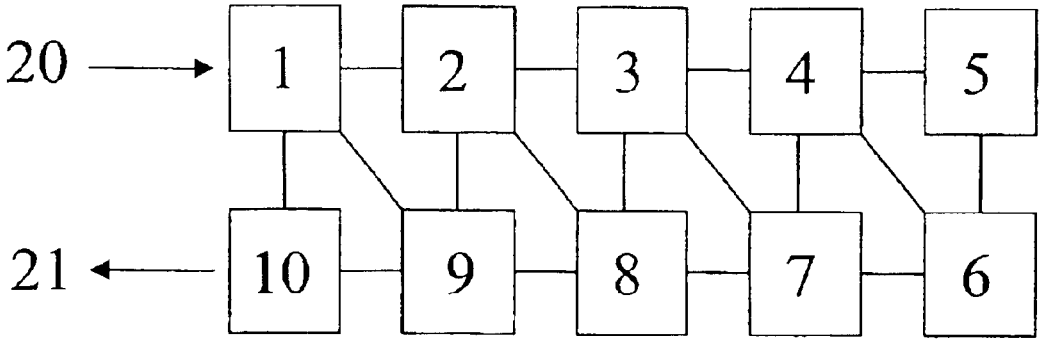
Fig. 1 PRIOR ART

The present invention relates generally to microwave filters, and more particularly, to general response bandpass microwave filters for use in transmitters and receivers for communication satellite and wireless communication systems.

STATE OF THE ART

Canonical topology for bandpass filters is known to provide general responses both symmetrical and asymmetrical, with the maximum number of finite zeros for a given number of resonators, thus allowing sharp selectivity and linear phase responses to be implemented.

One cononical single mode multi-cavity microwave filter is described in U.S. Pat. No. 5,608,363 to Cameron et al. wherein there is a multi-cavity housing formed with a plurality of walls defining a plurality of cavities, that are sequentially arranged in first and second side-by-side rows, each row having a plurality of cavities.

The filter housing has an input and an output such that an input device is arranged adjacent to and connected to a first cavity in the first row, and an output device is arranged adjacent to and connected to a cavity in the second row. Both input and output of the filter are parallel and lie at the same side of the filter.

A cylindrically shaped dielectric resonator is supported within each of the cavities. The wall between each of any two adjacent sequential cavities is provided with slots, namely irises, to couple adjacent sequential and non-sequential adjacent resonators.

The filter housing supports a plurality of adjustable fins or probes extending into the irises, one fin to each iris, to selectively adjust the size of the iris. Therefore, there are cavities having at least two couplings, namely in series when the coupled cavities are sequential and adjacent; in parallel or cross coupled when the coupled cavities are non-sequential and adjacent.

Different shaped probes are used to couple the cavities. Hence, a probe is positioned in the wall between at least two non-sequential adjacent cavities, one cavity in the first row and the other cavity in the second row thus cross coupling said two non-sequential cavities, the probe having opposite ends each of which extends in a direction generally parallel to the curvature of the cylindrically shaped resonators.

However, these known microwave filters suffer from various disadvantages such as a distortion appearing in the response that leads to an asymmetric response. This distortion prevents the filter meeting the prescribed specifications of flat insertion losses and linear phase.

Therefore, there is a need to add additional degrees of freedom by means of diagonal cross couplings for compensating for such distortion. The diagonal cross coupling is defined as the coupling between non-sequential non-adjacent resonator cavities that allow pre-distortion of the response and further control of the response characteristics.

Diagonal cross couplings are difficult to characterize, manufacture and tune and they increase the mechanical complexity and number of elements of the filter, thus raising the cost of the filter.

Moreover, cross couplings between non-sequential adjacent cavities are very low in magnitude for high order filters, leading to a difficult electrical characterization procedure, a complex manufacturing and tuning, and worse performances in temperature.

CHARACTERIZATION OF THE INVENTION

Therefore it is an object of the present invention to provide a canonical general response bandpass filter that provides a symmetrical response without using diagonal cross couplings.

Another object of the invention is to provide higher cross coupling values in order to simplify the characterisation and manufacture of the cross couplings.

The previously mentioned objects and others are accomplished by the use of a canonical structure such as a microwave filter comprising a plurality of resonator cavities arrangement in more than two adjacent rows and more than two adjacent columns; each resonator cavity is coupled with at least a sequential adjacent resonator cavity for providing a main path for an electromagnetic energy to be transmitted from a first resonator cavity to a last resonator cavity, the electromagnetic energy is injected in the first resonator cavity by an input terminal through an input coupling and the electromagnetic energy is extracted from the last resonator cavity by an output terminal through an output coupling, the first and last resonator cavities are non-sequential cross coupled adjacent cavities.

By using this invention the distortions are minimized and no diagonal cross couplings are needed in order to implement a symmetrical response.

Furthermore, the invention allows the placement of some cross couplings between the $i^{th}$ and $(i+z)^{th}$ resonators for $1 \leqq i \leqq n-z$, z being an odd number. Such cross couplings have higher values and therefore they are easily and accurately electrically characterized, thus less critical in terms of design, manufacturing and temperature dependence. This means a less costly filter with easier tuning and more stable performances over a wide temperature range.

BRIEF OUTLINE OF THE FIGURES

Figure 2:
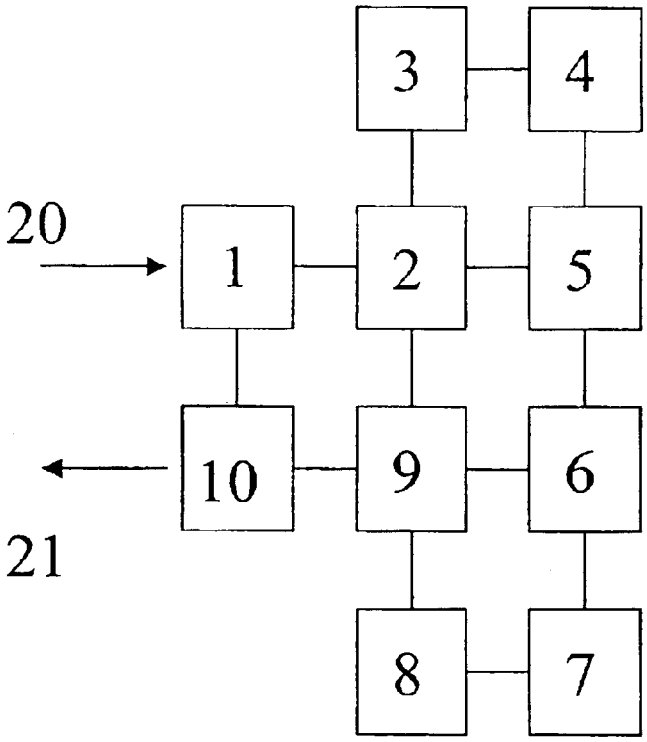
Figure 3:
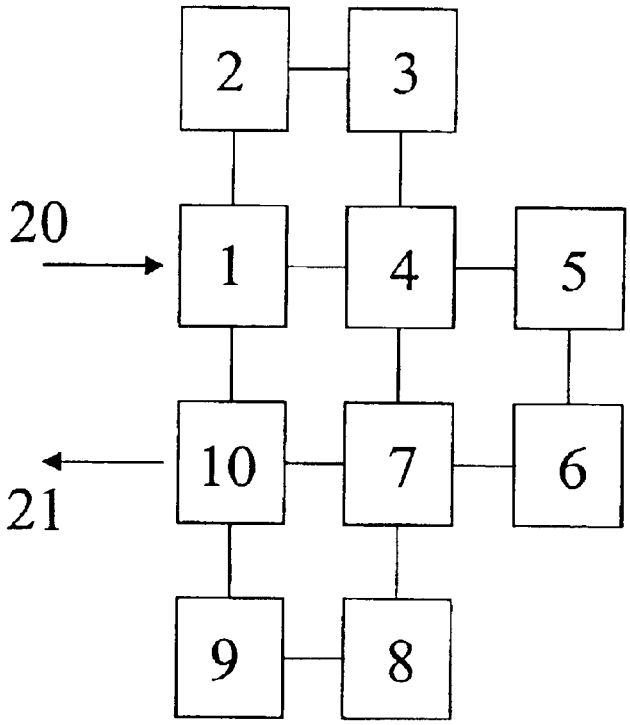
Figure 4:
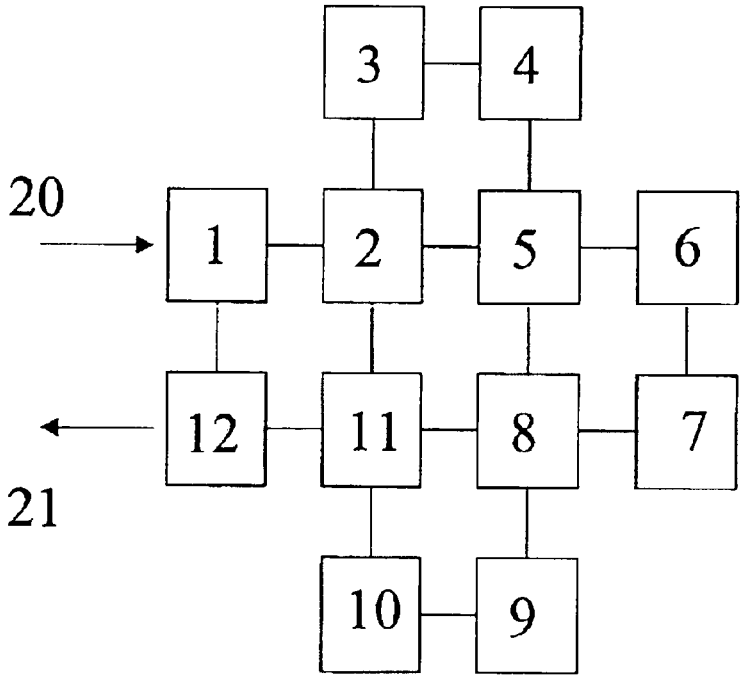
Figure 5:
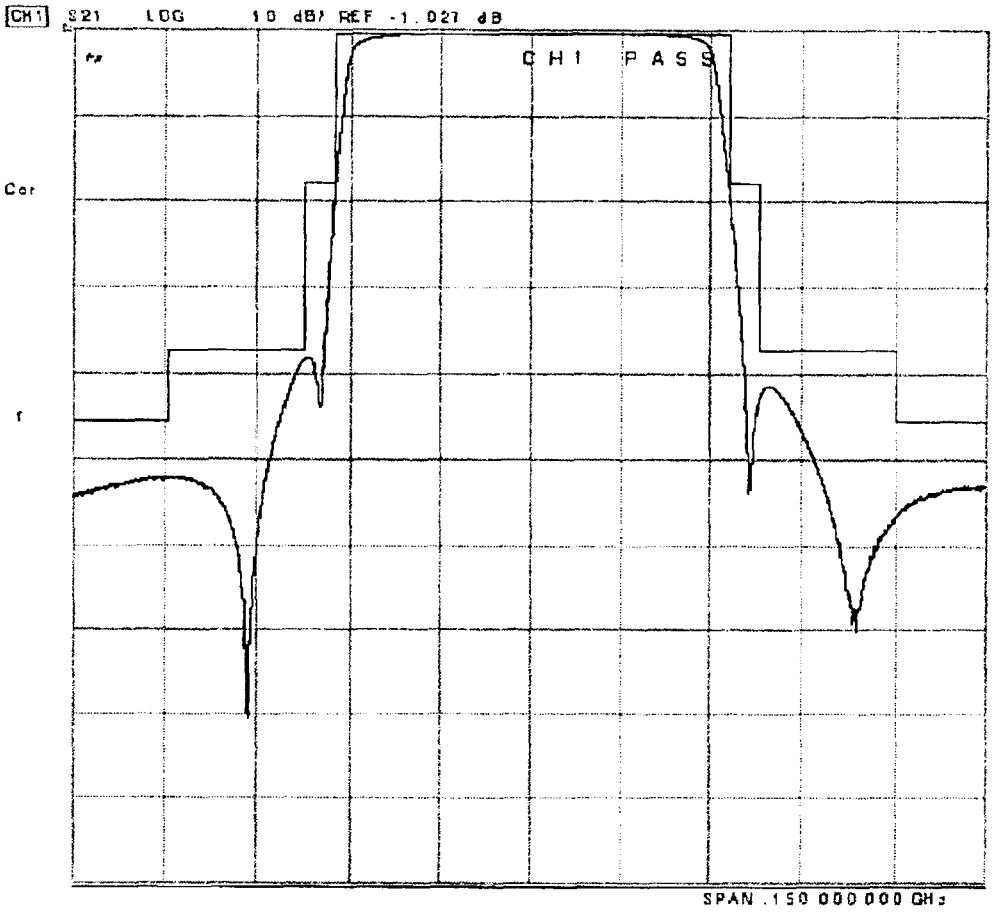
Figure 6:
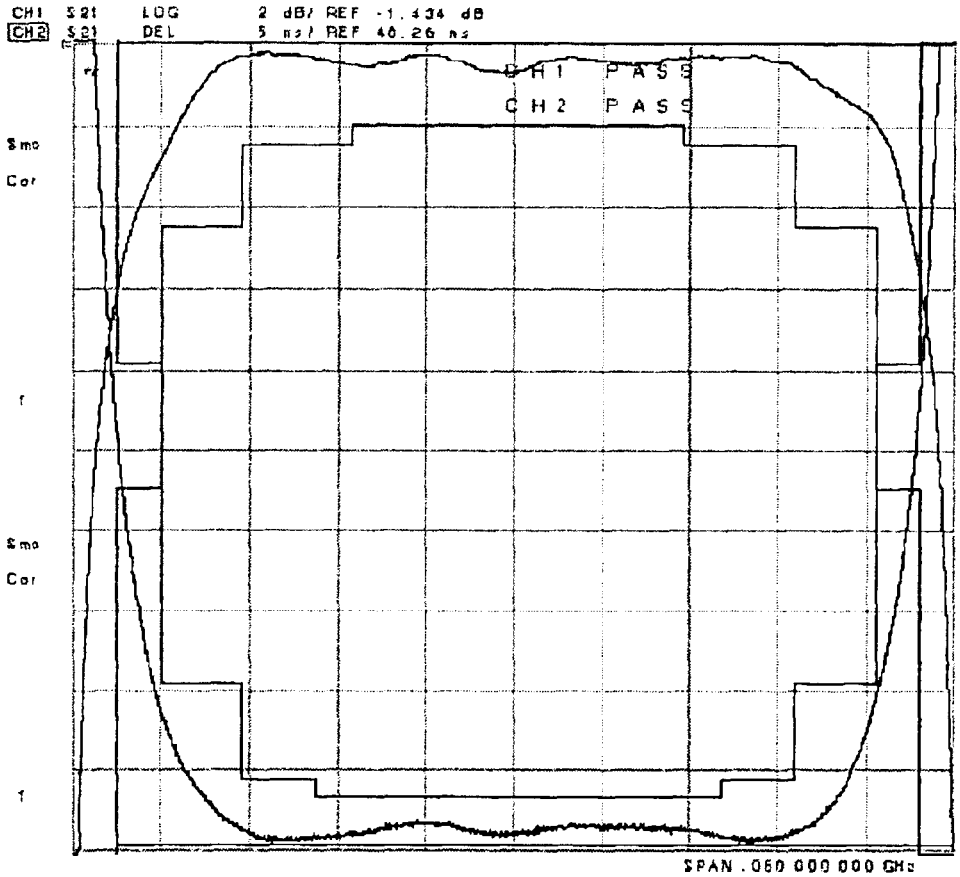

A more detailed explanation of the invention is given in the following description based on the attached figures in which:

FIG. 1 is a top view of a single mode microwave filter according to the prior art, FIG. 2 is a top view of a embodiment of the invention, FIG. 3 is a top view of another embodiment of the invention, FIG. 4 is a top view of another embodiment of the invention, and FIG. 5 and FIG. 6 show a response by a filter according to the invention.

DESCRIPTION OF THE INVENTION

FIG. 1 depicts a single mode dielectric resonator microwave filter whose housing is provided with an input terminal 20 and an output terminal 21 connected respectively to a resonator cavity, such that each resonator cavity defines a row. The filter housing has several resonator cavities arranged in two rows.

As to FIG. 2, a microwave filter is described according to the invention wherein the resonator cavities are arranged in several rows and several columns, that is, the resonator cavities define more than two rows and columns.

The first cavity 1 is connected to the filter input 20 which is non-sequential adjacent to a cavity 10 connected to the filter output 21. A resonator (not shown) is arranged within each resonator cavity such that the dielectric resonators are coupled one to another by means of an iris in the wall that separates one cavity from another.

A resonator cavity may be coupled to another resonator cavity and/or to several resonator cavities. Therefore, several couplings are defined. For example, the resonator cavity 1 is coupled in series to a resonator cavity 2. Moreover, the resonator cavity 1 is coupled to a resonator cavity 10 by means of a cross coupling. In addition, a resonator cavity may be coupled to several cavities for defining a main path.

Therefore, the filter comprises a plurality of n resonator cavities, ordered by ordinal numbers from 1 to 10 successively coupled one to another by means of openings made in the wall that separates one cavity from another and wherein the first cavity 1 is connected to the input terminal 20 which is adjacent to another cavity 10 connected to the output terminal 21 and there is a cross coupling between them. The couplings are shown by means of lines.

So, the filter provides the maximum number of transmission zeroes with the minimum number of elements and is thus a canonical filter.

The microwave filter includes an unitary housing having four rows and three columns wherein the input terminal 20 connected to the cavity 1 is non-sequential adjacent to the cavity 10 connected to the output terminal 21.

For the same number of rows and columns, for example, four rows and three columns, the resonator cavities 1 to 10 can be arranged in several shapes. This shown in FIG. 2 and 3.

However, the housing filter can have the same number of rows and columns, as shown in FIG. 4. In addition, the housing filter may have a different number of rows than the columns or vice versa.

The path, namely main path, for the electromagnetic energy goes from the input 20 to the output 21 successively passing only once through all the resonator cavities 1, 10 and the couplings between them are multiply folded, that is, it goes through more than two rows and several columns of resonator cavities.

In any case, the housing filter of the invention comprises several resonator cavities wherein there are any resonator cavities that alone have couplings in series, for example, resonator cavity 3; another resonator cavity may have two coupling in series and two cross coupling, for example, resonator cavity 2; also, there is any resonator cavity may have two coupling in series and one cross coupling, for example, resonator cavity 5, see FIG. 2.

As a result, the housing filter allows the placement of some cross couplings between the $i^{th}$ and $(i+z)^{th}$ resonators for $1 \leqq i \leqq n-z$, z being an odd number; for example, the cavity 5 has a cross coupling with the cavity 8, shown in FIG. 2 and 3.

Further, the housing filter allows the number of resonator cavities per row to be different, that is, not all rows have the same number of resonator cavities. Also, not all columns have the same number of resonator cavities, shown in FIG. 2 and 3.

For example, column 1 has two resonator cavities being cavities 1 and 10, and column 2 has four resonator cavities being 3, 2, 9 and 8, shown in FIG. 2.

As to FIG. 3, row 1 has two resonator cavities being cavities 9 and 8, and row 2 has three resonator cavities being 10, 7 and 6.

As to FIG. 5 and FIG. 6, these show transmission response of a ten-pole filter using dielectric resonator technology using the embodiment depicted in FIG. 3.

Note that each resonator cavity may include a dielectric resonator. The housing filter has been without diagonal cross coupling, however, this kind of cross coupling may be establish between two resonator cavities are non-sequential non adjacent cavities, for example, the cavity 2 may be coupled to cavity 8 by means a diagonal cross coupling, see FIG. 4. In addition, diagonal cross coupling may be defined in the microwave filter of the invention.

The present invention has been described by means of an example in order to show its advantages in practical applications but it should not be considered restrictive in any way, thus variations or modifications that will lead to other embodiments evident for those skilled in the field of microwave filters must be included in the scope of this invention.

What is claimed is:

1. A canonical general response bandpass microwave filter comprising a plurality of resonator cavities arrangement in rows, each resonator cavity being coupled with at least a sequential adjacent resonator cavity for providing a main path for an electromagnetic energy to be transmitted from a first resonator cavity (1) to a last resonator cavity, the electromagnetic energy being injected into the first resonator cavity (1) by an input terminal (20) through an input coupling, and the electromagnetic energy being extracted from the last resonator cavity by an output terminal (21) through an output coupling, the first and last resonator cavities being non-sequential cross coupled adjacent cavities; wherein the resonator cavities are arranged in more than two adjacent rows and more than two adjacent columns.

2. The microwave filter according to claim 1, wherein at least one resonator cavity is adapted to couple a sequential adjacent resonator cavity and a non-sequential adjacent cavity.

3. The microwave filter according to claim 2, wherein at least one resonator cavity is adapted to couple at least two sequential adjacent resonator cavities and at least one non-sequential adjacent cavities.

4. The microwave filter according to claim 3, wherein at least one resonator cavity is adapted to couple at least two sequential adjacent resonator cavities and at least two non-sequential adjacent cavities.

5. The microwave filter according to claim 4, wherein at least one resonator cavity is adapted to couple at least two sequential adjacent resonator cavities, at least two non-sequential adjacent cavities and at least one non sequential non adjacent cavity.

6. The microwave filter according to claim 3, wherein at least one resonator cavity is adapted to couple at least two sequential adjacent resonator cavities, at least one non-sequential adjacent cavity and at least one non sequential non adjacent cavities.

7. The microwave filter according to claim 1, including more rows than columns.

8. The microwave filter according to claim 1, comprising more columns than rows.

9. The microwave filter according to claim 1, including an equal number of columns and rows.

10. The microwave filter according to claim 1, wherein at least one row has a lower number of resonator cavities than another row.

11. The microwave filter according to claim 1, wherein at least one column has a lower number of the resonator cavities than another column.

12. The microwave filter according to claim 1, wherein the main path passes through more than two rows and two columns of resonator cavities.

13. The microwave filter according to claim 1, wherein each resonator cavity comprises a dielectric resonator.

14. The microwave filter according to claim 1, wherein each resonator cavity is an empty wave guide cavity.

15. The microwave filter according to claim 1, wherein each resonator cavity is a coaxial resonator.

* * * * *